US005697392A

United States Patent [19]

Johnson et al.

[11] Patent Number: 5,697,392

[45] Date of Patent: Dec. 16, 1997

[54] APPARATUS FOR SPRAYING WASHING FLUID

[75] Inventors: Thomas M. Johnson; Brian L. Ness; Jeffrey T. Jones; Rodney M. Welch, all of Newton, Iowa

[73] Assignee: Maytag Corporation, Newton, Iowa

[21] Appl. No.: 623,877

[22] Filed: Mar. 29, 1996

[51] Int. Cl.[6] ..... A47L 15/23

[52] U.S. Cl. ..... 134/176; 134/183; 239/232; 239/244; 239/245

[58] Field of Search ..... 134/176, 179, 134/183; 239/232, 233, 244, 245, 251, 261

[56] References Cited

U.S. PATENT DOCUMENTS

| | | | |
|---|---|---|---|
| 2,943,633 | 7/1960 | Marmo et al. | 134/174 |
| 3,067,759 | 12/1962 | Guth et al. | 134/176 |
| 3,126,025 | 3/1964 | Aubert et al. | 134/176 |
| 3,144,034 | 8/1964 | Lyman et al. | 134/176 |
| 3,146,953 | 9/1964 | Komanns | 239/538 |
| 3,213,866 | 10/1965 | Martiniak | 134/176 X |
| 3,288,156 | 11/1966 | Jordan et al. | 134/176 |
| 3,292,645 | 12/1966 | Braden et al. | 134/176 X |
| 3,368,573 | 2/1968 | Mixon | 134/176 |
| 3,570,506 | 3/1971 | Reifenberg | 134/183 |
| 3,648,931 | 3/1972 | Jacobs | 134/176 X |
| 3,774,626 | 11/1973 | Schweitzer | 134/179 |
| 3,969,137 | 7/1976 | Jenkins et al. | 134/176 |
| 4,174,723 | 11/1979 | Long | 134/176 X |
| 5,427,129 | 6/1995 | Young, Jr. et al. | 134/176 |

*Primary Examiner*—Philip R. Coe
*Attorney, Agent, or Firm*—Zarley,McKee,Thomte,Voorhees & Sease

[57] ABSTRACT

A spray assembly for a dishwasher includes a fluid pump and a spray tower. The spray tower includes a lower stationary member and an upper rotatable member and includes a fluid cavity therein. The rotatable member has at least one spray opening adjacent its upper end. A spray nozzle directs a stream of washing fluid upwardly into the spray tower and moves the stream of washing fluid in a circular pattern. The stream of water engages the upper rotatable member of the spray tower and the upper rotatable member rotates in response thereto. One form of the invention uses a deflecting surface on the rotatable member for causing rotational movement of the rotatable member and for causing precession of the rotatable member. Another modification of the present invention utilizes a pair of intermeshing gears for causing precession of the rotatable member.

15 Claims, 8 Drawing Sheets

APPARATUS FOR SPRAYING WASHING FLUID

BACKGROUND OF THE INVENTION

This invention relates to a method and apparatus for spraying washing fluid.

Many present dishwashers include a lower wash arm that rotates about a vertical axis. These dishwashers also usually include an upper or second level spray mechanism to provide a spray both upward and radially outward onto the articles within the dishwasher.

Some prior art dishwashers utilize a fixed tower which extends upwardly from the lower wash arm and which directs washing fluid from the lower wash arm upwardly to a spray head at the top of the tower. One deficiency of this type of spray head is that the sprays usually travel in regular patterns, and therefore strike the same locations within the dishwasher during each rotation of the spray head.

Therefore a primary object of the present invention is the provision of an improved method and apparatus for spraying washing fluid within a dishwasher.

A further object of the present invention is the provision of an improved method and apparatus for spraying washing fluid which causes a spray head or diverter at the top of a vertical tower to rotate and create a rotating spray pattern within the dishwasher.

A further object of the present invention is the provision of an improved method and apparatus for spraying washing fluid within a dishwasher from the top of a tower in a pattern which is controlled, but which is random and contacts many different locations within the dishwasher.

A further object of the present invention is the provision of an improved method and apparatus for spraying washing fluid which includes a rotating spray head or deflector at the top of a tower for providing a random spray pattern during the time that the spray head rotates.

A further object of the present invention is the provision of an improved method and apparatus for spraying washing fluid which includes a spray head at the top of a tower which rotates at a different speed from the lower wash arm at the bottom of the tower.

A further object of the present invention is to provide a spray head which will increase the dwell time of the spray pattern from the spray head in any area of the wash chamber.

A further object of the present invention is the provision of an improved method and apparatus for spraying washing fluid which rotates a spray head at the top of a tower in a direction opposite from the direction of rotation of the spray arm.

A further object of the present invention is the provision of an improved method and apparatus for spraying washing fluid which directs a rotating column of water up through the interior of a tower to a deflector spray head mounted at the top of the tower.

A further object of the present invention is the provision of an improved method and apparatus for spraying washing fluid which is economical to manufacture, durable in use and efficient in operation.

SUMMARY OF THE INVENTION

The foregoing objects may be achieved by a spray assembly which includes a fluid pump and a spray tower having a lower stationary member and an upper rotatable member mounted for rotation about a first rotational axis with respect to the stationary member. The stationary member includes a fluid cavity therein and the rotatable member includes a spray opening in communication with the fluid cavity of the stationary member for receiving fluid therefrom and for directing the fluid outwardly away from the spray tower. A spray nozzle is connected to the fluid pump for receiving pressurized washing fluid therefrom and for directing a stream of the washing fluid into the fluid cavity of the stationary member and outwardly through the spray opening of the rotatable member. The spray nozzle is rotatable about a nozzle axis for moving the stream of washing fluid in a pattern which extends circumferentially around the first rotational axis of the rotatable member.

In one modification of the invention the rotatable member includes a deflecting surface for receiving the stream of fluid and for causing rotation of the rotatable member about its first rotational axis in response to receiving the stream of fluid. In one species of this modification the position of the spray nozzle, the direction of the first rotational axis of the rotatable member, and the shape of the deflecting surface on the rotatable member are chosen so as to cause movement of the rotatable member in the same rotational direction as that of the spray nozzle. In another species of this modification the rotatable member rotates in the same direction and at the same speed as the rotation of the spray nozzle in response to engagement of the stream of washing fluid with the deflecting surface of the rotatable member.

In another modification of the present invention a gear mechanism interacts with the rotation of the nozzle so as to cause rotation of the rotatable member in the opposite direction with respect to rotation of the spray nozzle.

DETAILED DESCRIPTION OF THE PREFERRED EMBODIMENT

Figure 1:
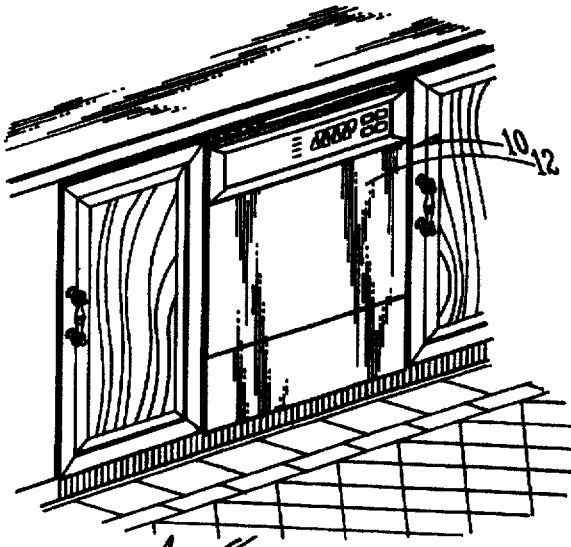
FIG. 1 is a perspective view of a dishwasher mounted beneath a typical kitchen countertop.
Figure 2:
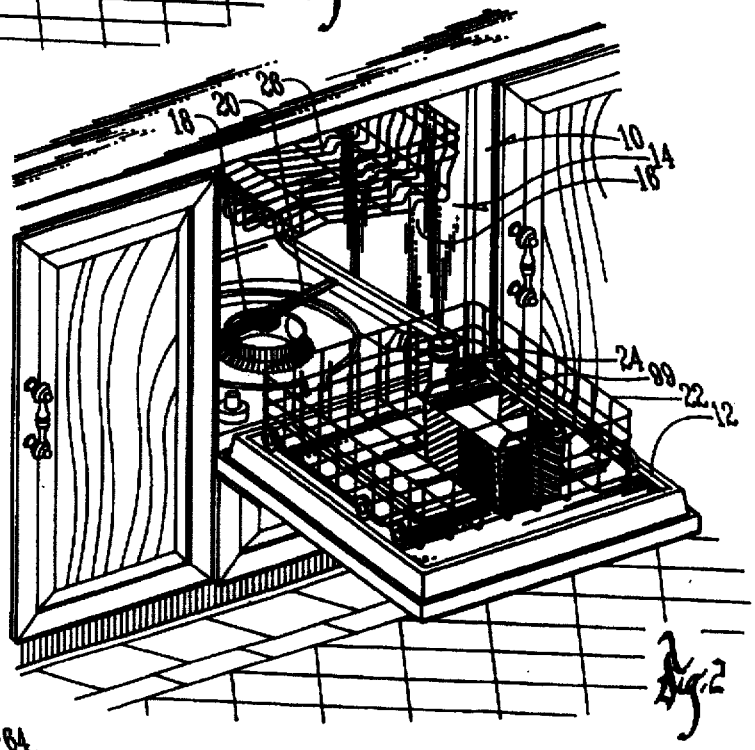
FIG. 2 is a view similar to FIG. 1, but showing the door of the dishwasher in an open position.

Referring to FIGS. 1 and 2, a dishwasher 10 includes a dishwasher door 12 which opens into a washing compartment 14 formed by a tub 16. In the bottom of tub 16 is a pump 18 which is connected to and provides washing fluid to a wash arm assembly 20. A lower rack 22 includes a spray tower 24, which when rack 22 is inserted into the dishwasher 10 registers above the vertical rotational axis of the wash arm assembly 20. Also included within the washing compartment 14 above the top of spray tower 24 is an upper rack 26.

Figure 4:
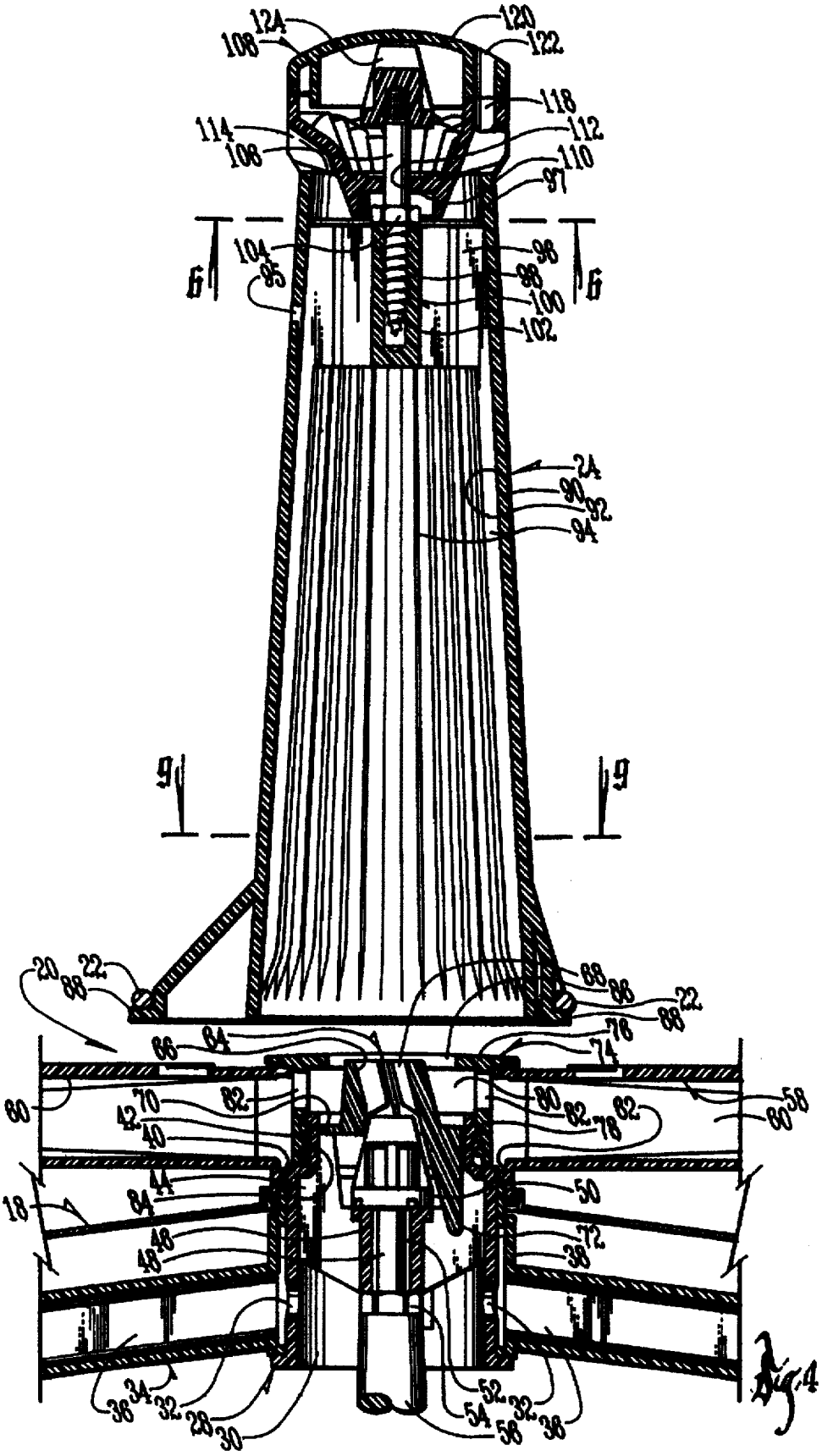
FIG. 4 is a sectional view taken along line 4—4 of FIG. 3.

The structure of wash arm assembly 20 is shown in FIG. 4 in cross-section. A wash arm manifold 28 encloses a cylindrical cavity 30 for receiving pressurized washing fluid from pump 18. A plurality of radial ports 32 extend radially outwardly from cavity 30 for introducing pressurized fluid from cavity 30 into spray arm cavities 36 which are within filter spray arms 34. Filter spray arms 34 are rotatably mounted within the housing of pump 18 and are adapted to deliver washing fluid to backwash the filter within the pump in conventional fashion. Filter spray arms 34 are connected to a central filter spray hub 38 which is keyed to and rotates with the wash arm manifold 28.

Wash arm manifold 28 includes adjacent its upper end an upwardly facing shoulder 40. Extending upwardly from shoulder 40 is a threaded shank 42 having a plurality of radially extending vanes 44 centrally mounted therein. At the center of the radial vanes 44 is a central sleeve 46 which rotates about the shank 52 of an axle bolt 48. Threaded over the upper end of axle bolt 48 is a cap 50 and extending downwardly therefrom is the shank 52 about which the wash arm manifold 28 rotates. At the lower end of shank 52 is a nut 54 integrally formed as part of axle bolt 48. Axle bolt 48 continues downwardly from nut 54 and is threadably contained within a shaft 56 which supports the wash arm manifold 28.

Wash arm assembly 20 also includes a wash arm 58 having a pair of opposed wash arm cavities 60. Wash arm 58 includes a central opening 62.

Figure 10:
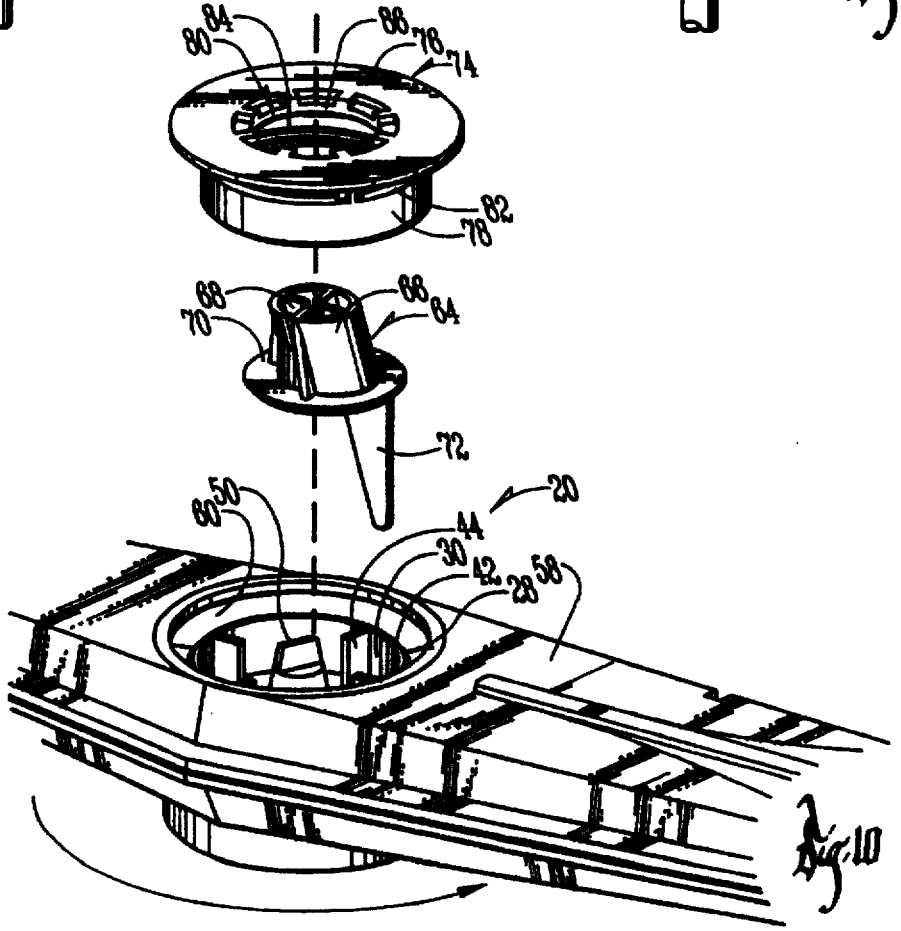
FIG. 10 is an exploded perspective view of the wash arm, spray nozzle, and wash arm cap of the present invention.
Figure 14:
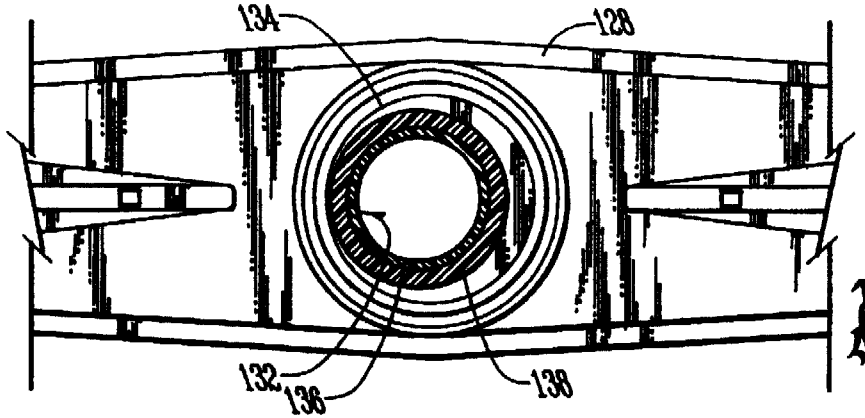
FIG. 14 is a sectional view taken along line 14—14 of FIG. 12.

As best shown in FIG. 10, spray nozzle 64 includes an angled spout 66 having an angled spray port 68 therein. Nozzle 64 also includes an annular flange 70 and a depending finger 72 extending downwardly from the annular flange 70. Spray nozzle 64 rests upon the upper edges of radial vanes 44, and depending finger 72 protrudes downwardly between the radial vanes 44. A wash arm cap 74 includes a top flange 76 and a depending sleeve or cylinder 78. Within sleeve 78 is a cap cavity 80, and a plurality of ports 82 provide communication from cap cavity 80 into the wash arm cavities 60. Sleeve 78 of wash arm cap 74 includes threads 84 which threadably engage threaded shank 42 of wash arm manifold 28. Wash arm cap 74 includes a jump up opening 86 through which the angled spout 66 of spray nozzle 64 can jump upwardly. The annular flange 70 of spray nozzle 64 prevents the spray nozzle 64 from passing completely through and provides an annular seal around the jump up opening 86. The depending finger 72 of spray nozzle 64 causes the spray nozzle 64 to drop freely downwardly to its lower position shown in FIG. 4 from its elevated position shown in FIG. 5 without becoming lodged or misaligned within the interior of the cap cavity 80.

The operation of wash arm 58 commences when pump 18 is activated to introduce washing fluid under pressure into the cylindrical cavity 30 of wash arm manifold 28. This fluid engages the annular flange 70 of spray nozzle 64 and forces it to jump upwardly from its lower position shown in FIG. 4 to its elevated position shown in FIG. 5. At the same time washing fluid passes under pressure from the cap cavity 80 through the ports 82 into the wash arm cavities 60. Wash arm 58 is provided with a plurality of jet spray openings (not shown) which permit the spraying of washing fluid from wash arm cavities 60 onto articles being cleaned.

Figure 5:
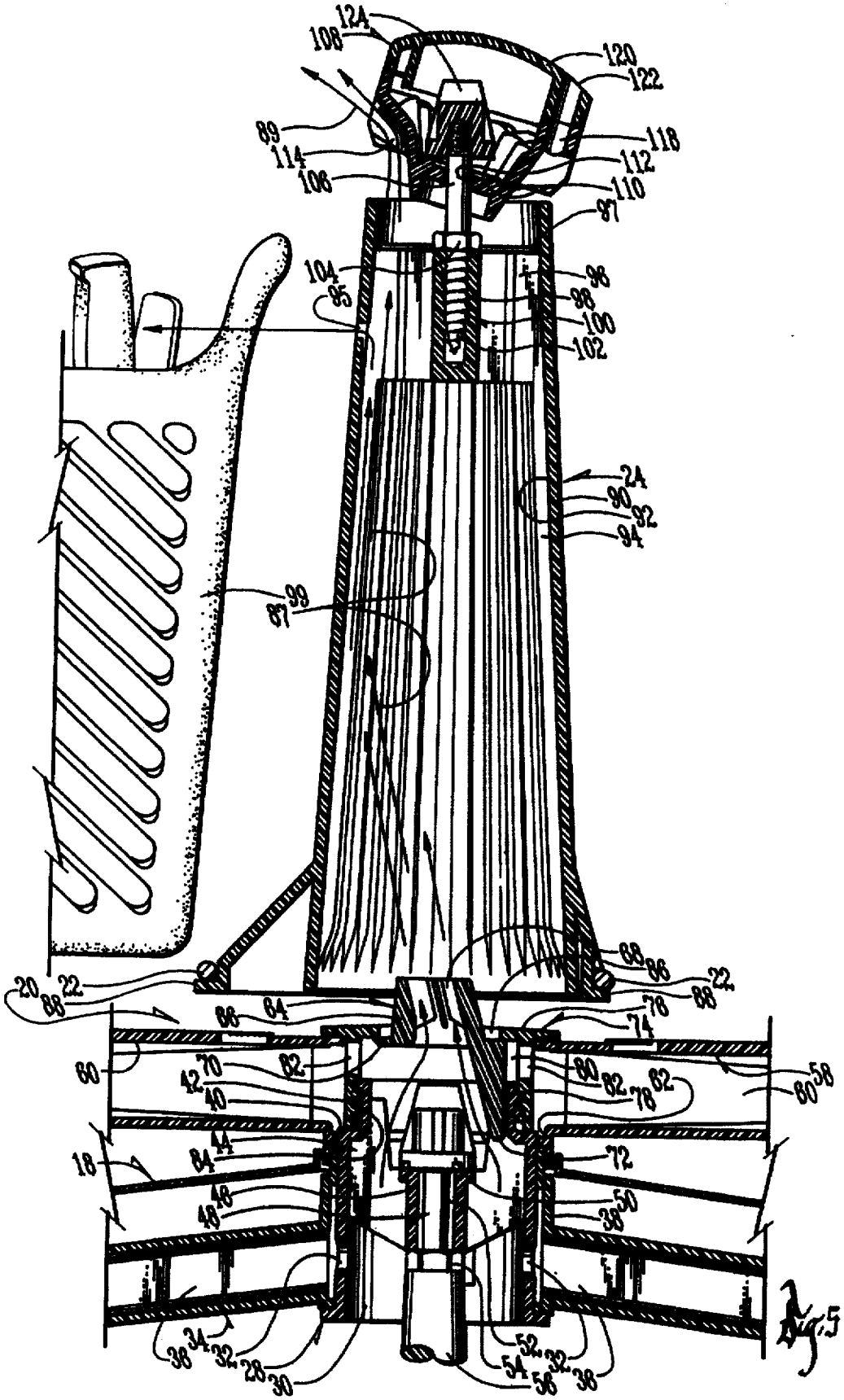
FIG. 5 is a view similar to FIG. 4, but showing the diverter in its elevated position.

Pressurized washing fluid also passes through angled spray port 68 in the direction shown by arrows 87 in FIG. 5.

Spray tower 24 includes a base flange 88 which is adapted to fit beneath the cross members of lower rack 22 in such a manner as to secure the spray tower 24 in a stationary position registered above spray nozzle 64. Tower 24 also includes an upstanding tower tube 90 having an elongated upstanding tube cavity 92 which is lined with a plurality of upstanding ribs 94. At the upper end of tower tube 90 are a plurality of radially extending vanes 96 which are connected at their inner ends by a central section 98. A bolt 100 has a lower threaded end 102 which is threaded within central section 98. Immediately above central section 98 on bolt 100 is a nut 104 and extending upwardly therefrom is a shank 106.

The upper ends of the upstanding ribs 94 and the vanes 96 are spaced somewhat below the uppermost end of the spray tower 24. An annular ring 97 is formed at the upper ends of the ribs 94 and vanes 96 and extends just slightly radially into the inside diameter of the tube cavity 92 at that level. As washing fluid moves along the ribs 94 and toward the spray head 108, the washing fluid will encounter a portion of the annular ring 97 and will be directed slightly toward the center line of spray tower 24 just prior to contact with the deflector subsurfaces 116. It has been found that redirecting the spray with the annular ring 97 enhances the shape of the washing fluid stream as it flows off the subsurfaces 116 providing a more active washing fluid stream for contact with the items being washed.

Figure 3:
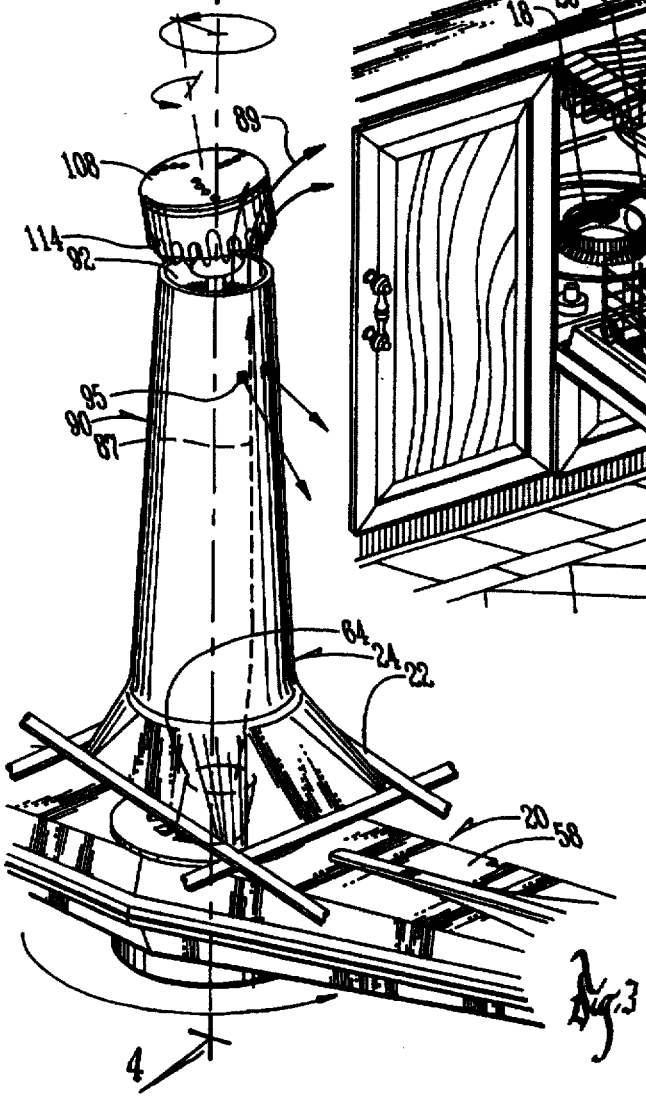
FIG. 3 is an enlarged perspective view of the apparatus for spraying washing fluid.

As further shown in FIGS. 3, 4 and 5, spray tower 24 includes a pair of forwardly facing apertures 95. These apertures 95 specifically direct a pair of fluid jets forwardly through the handle opening of the silverware basket 99 to enhance the cleaning of utensil portions that extend upwardly above the top edge of the silverware basket 99.

Figure 6:
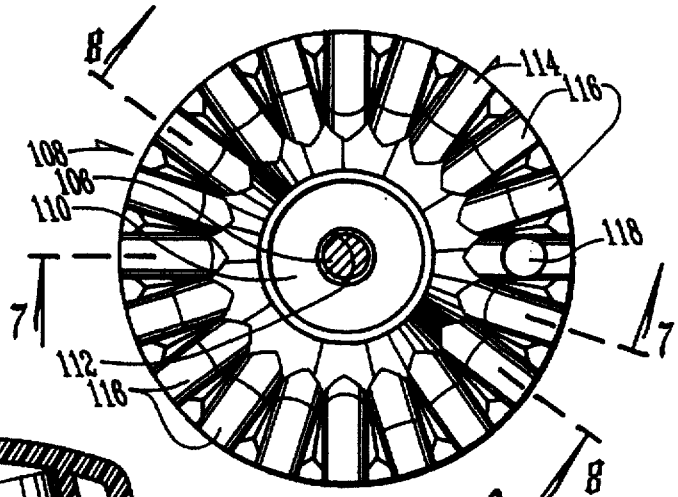
FIG. 6 is a sectional view taken along line 6—6 of FIG. 4.

A rotatable member is formed by a diverter or spray head 108 which includes a bottom wall 110 having a swivel opening 112 therein. Extending around the circumference of diverter 108 is a deflector surface 114 which is comprised of a plurality of deflector subsurfaces 116 (FIG. 6) which extend radially outwardly from the swivel opening 112. Each of the deflector surfaces 116 has a cross-sectional shape which is in the form of an inverted U, but each of the deflector subsurfaces 116 is slightly different in shape from the others so as to deflect a spray pattern which is slightly different from the spray pattern created by the other deflector surfaces. A vertical port 118 extends vertically through diverter 108 adjacent the outer periphery thereof and is in registered alignment with a vertical port 122 of a diverter cap 120 which is detachably secured over the top of diverter 108. The aligned vertical ports 118 and 122 provide a washing fluid stream directly to preselected areas in the upper rack 26. A cap nut 124 is threaded over the upper end of bolt 100, and exposes a length of shank 106.

Figure 7:
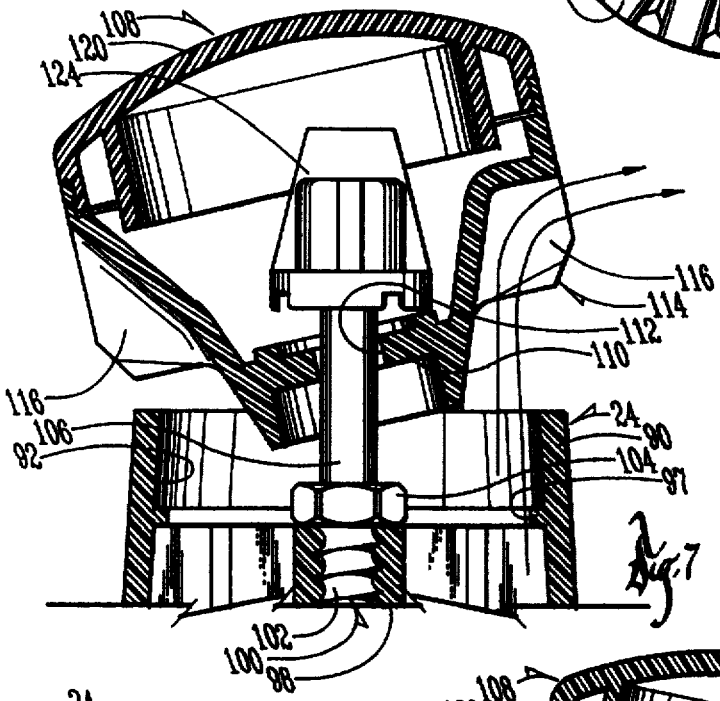
FIG. 7 is a sectional view taken along line 7—7 of FIG. 6.
Figure 8A:
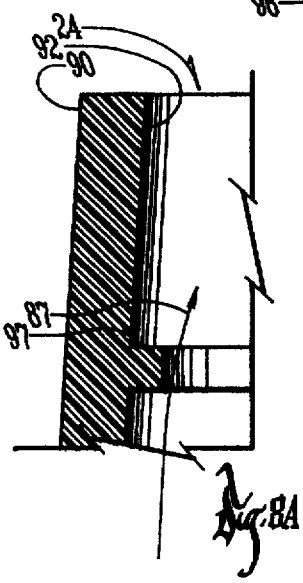
FIG. 8*a* is an enlarged partial section view of the top portion of the spray tower taken along line 8*a*—8*a* of FIG. 8.
Figure 8:
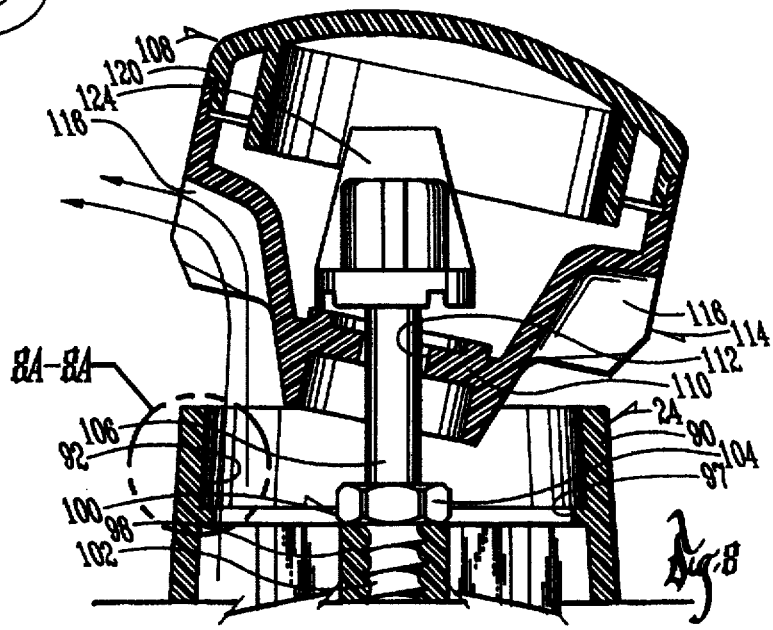
FIG. 8 is a sectional view taken along line 8—8 of FIG. 6.
Figure 9:
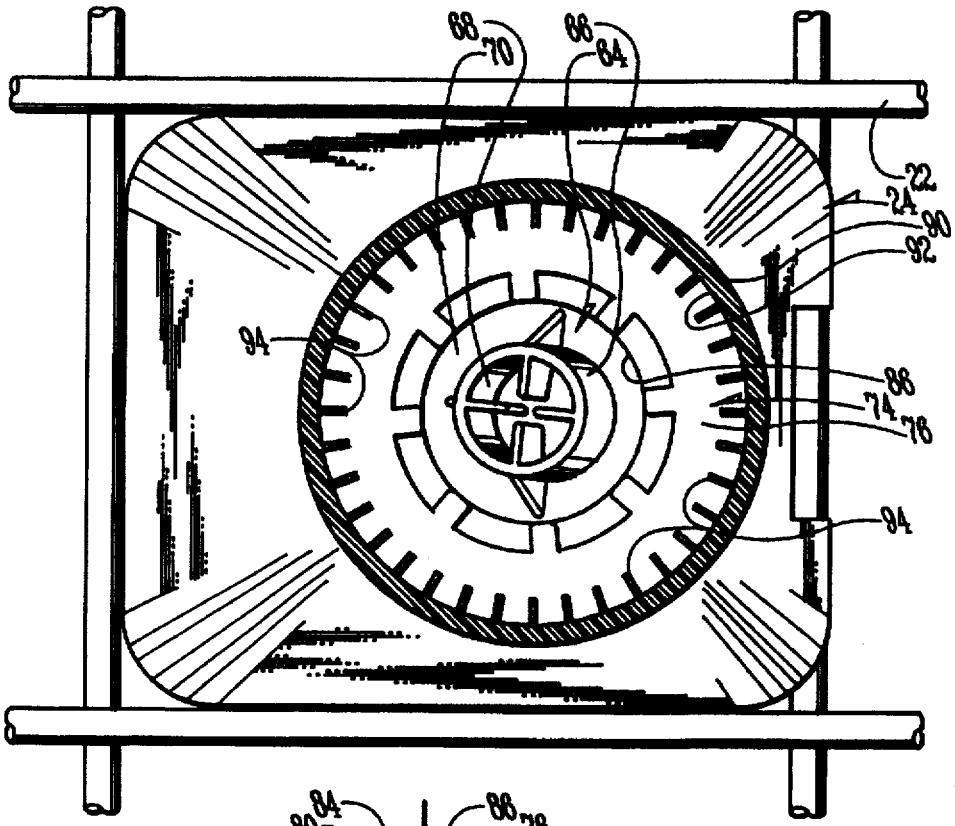
FIG. 9 is a sectional view taken along line 9—9 of FIG. 4.

An important feature of the present invention is the fact that the swivel opening 112 is slightly larger than the diameter of shank 106 as is illustrated most clearly in FIGS. 7 and 8. This permits the diverter 108 to tilt with respect to its mounting on shank 106 in the manner shown in FIGS. 7 and 8. While in the preferred embodiment, the tilt angle of the diverter 108 is about 7° from vertical, the present invention is not to be limited to this specific angle. Swivel opening 112 also permits the diverter 108 to rotate with respect to shank 106. The third type of movement permitted is illustrated by the initial lowered position of diverter 108 shown in FIG. 4 and the elevated position of diverter 108 shown in FIGS. 5, 7 and 8.

The operation of the wash arm 58 and the spray nozzle 64 have been described above. This results in a stream of washing fluid exiting from the angled spray port 68 of spray nozzle 64 at an angle of inclination similar to that shown by arrows 87 in FIG. 5. The column of water strikes the interior surface of tower tube 90 and is directed upwardly by the ribs 94 which extend upwardly generally parallel to one another within the interior surface of tube cavity 92.

When the column of water exits the top of spray tower 24 it engages a portion of the deflector subsurfaces 116 and causes the diverter 108 to move from its lowered position shown in FIG. 4 to its elevated tilted position shown in FIG. 5. As indicated by the arrows 89 the column of water is diverted radially outward by the subsurfaces 116 in a direction which extends upward and radially away from the spray tower 24.

Because wash arm 58 is rotating and consequently spray nozzle 64 is also rotating, the column of water represented by arrows 87 moves around the interior circular surface of spray tower 24 in a circular pattern which surrounds and is spaced radially outwardly from the vertical central axis of spray tower 24. This circular movement also causes the spray column to move around the circular deflector surface 114 so that it engages the different subsurfaces 116. This causes the tilting axis of the diverter 108 to rotate in a cone shaped pattern. Also, the circular movement of the spray column cooperates with the subsurfaces 116 to cause the diverter to precess in a rotational direction which is the same as the direction of circular movement of the fluid column within spray tower 24. As used herein, the term "precession" refers to the above described complex motion executed by the rotating diverter 108 when subjected to a torque tending to change its axis of rotation marked by a conical locus of the axis. This results in the diverter 108 rotating in the same direction as the rotational direction of wash arm 58. Diverter 108 also rotates at a velocity which is slower than the rotational velocity of the wash arm 58 providing a lengthened dwell time of the deflected stream or spray pattern upon articles placed in upper rack 26 for cleaning.

Furthermore, partially because each of the subsurfaces 116 has a slightly different contour, the spray pattern created and designated by the arrows 89 is random. Thus, if a glass for example is positioned in upper rack 26, the spray pattern strikes the glass at a randomly different spot and for an extended period each time the column of water rotates around the interior of spray tower 24. This random action is caused by the many unique contours of the subsurfaces 116 and by the fact that the diverter 108 has a conical locus of motion and a velocity which is different from the rotational velocity of the spray column within spray tower 24 caused by the rotation of wash arm 58 and spray nozzle 64. The term precession as used herein refers to the complex motion executed by the rotating diverter 108 being subjected to a torque tending to change its axis of rotation (as a result of the column of washing fluid) marked for constant speed of rotation and constant magnitude of the applied torque by a conical locus of the rotational diverter axis of the diverter 108.

In summary, as the spray nozzle 64 rotates with the wash arm 58, a stream of fluid identified by numeral 87 impinges on the inner diameter of spray tower 24 and into the spaces between ribs 94 so that the stream of fluid 87 rotates at the same rotational velocity as the wash arm 58. Toward the top of the spray tower 24, the stream of fluid 87 contacts the annular ring 97 and is deflected slightly inward as shown in FIG. 8*a*. The stream of fluid 87 continues upward and contacts the deflecting subsurfaces 116 moving the diverter 108 upward while tilting it on the shank 106. As the stream of fluid 87 rotates and contacts the deflecting subsurfaces 116, the stream of fluid identified by numeral 89 leaving the subsurfaces 116 is characterized by a substantially circumferential component provided by rotation of the diverter 108 as well as a constantly changing vertical component provided by the various deflecting subsurfaces 116 and the tilt caused by precession of diverter 108 as the stream of fluid at 87 rotates around the inner diameter of the spray tower 24. Thus, as the diverter 108 precesses about its rotational axis at a speed much slower than the speed of the wash arm 58, the vertical component of the spray of fluid at 89 leaving the subsurfaces 116 will be slightly different at any given location around the diameter of the spray tower 24 each time the stream of fluid indicated by numeral 87 rotates past that location. In other words, the fluid spray pattern from this system is constantly changing and random in nature so that a given area in the washing compartment 14 will not be subjected to a regular or repeating spray pattern.

Figure 12:
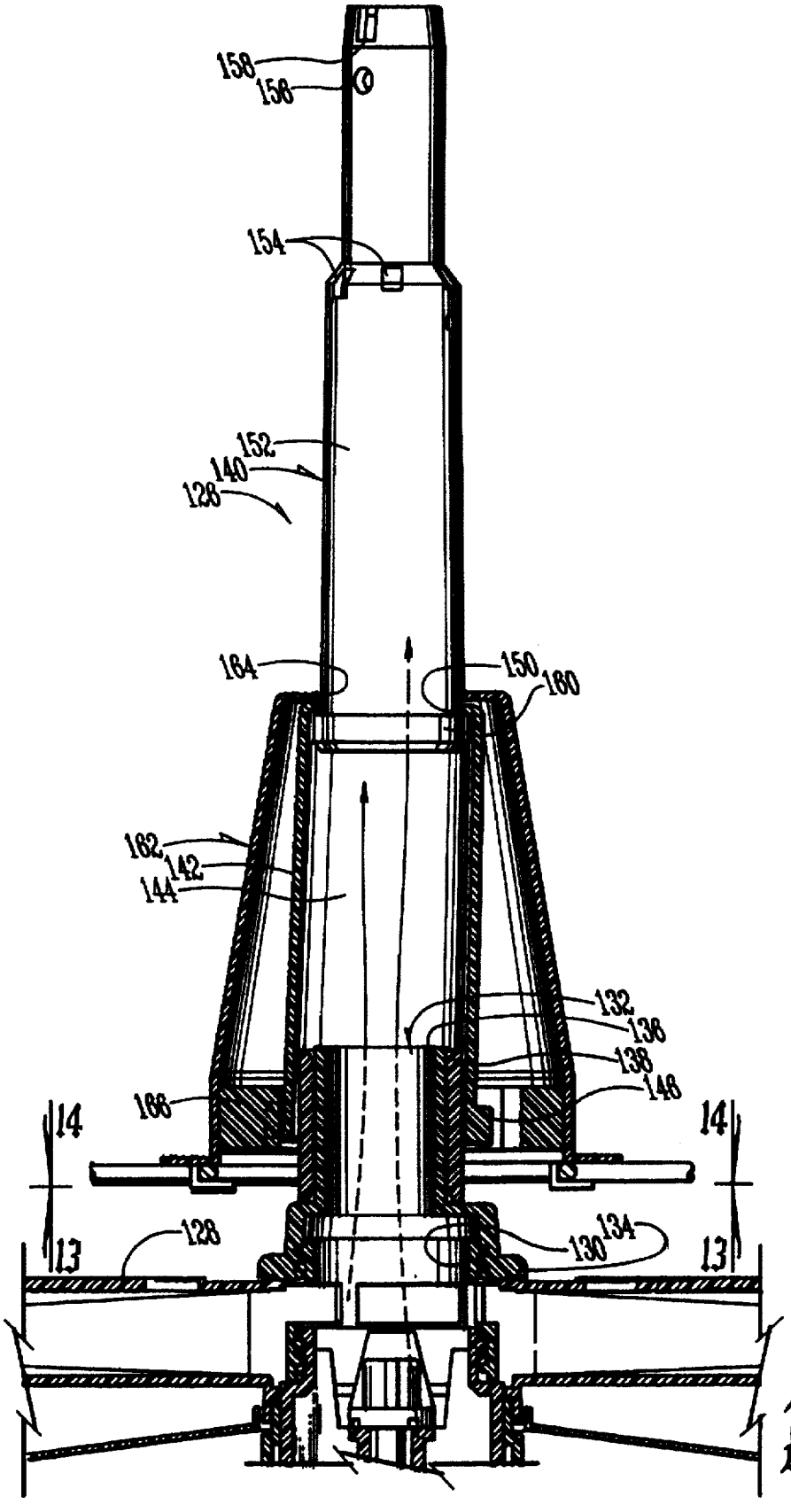
FIG. 12 is a sectional view taken along line 12—12 of FIG. 11.

Referring to FIGS. 11–14 a modified form of the present invention is designated generally by the numeral 126. As best shown in FIG. 12, wash arm 128 is mounted for rotation much in the same fashion as the wash arm 58 shown in FIGS. 1–10. Wash arm 128 includes a threaded boss 130. Threaded over boss 130 is an eccentric member 132 having a threaded base 134 threadably engaging boss 130 and having an upwardly extending nozzle 136. Nozzle 136 is eccentrically located with respect to the rotational axis of wash arm 128, but is adapted to rotate in unison with wash arm 128 about the rotational axis of wash arm 128. This causes the bottom of the vertical central axis of nozzle 136 to move in a circular pattern around the rotational axis of wash arm 128.

Slideably fitted over the outside of nozzle 136 is a bearing sleeve 138 which also rotatably fits within the lower end of a bottom section 142 of a telescoping tower 140. Bottom section 142 includes a fluid chamber 144 for receiving pressurized fluid from the upper end of nozzle 136. The lower end of bottom section 142 includes a planetary gear 146 extending around its outer circumference. Gear 146 has a plurality of gear teeth 148 on its outer circumference.

The upper end of bottom section 142 includes an opening 150 through which an upper section 152 is telescoped. Upper section 152 includes a plurality of intermediate spray openings 154, a radial spray opening 156 adjacent the top thereof and a top spray opening 158 along the top edge thereof. Upper section 152 also includes a bottom flange 160 which engages the margins of upper opening 150 so as to limit the upward telescoping movement of upper section 152 with respect to lower section 142.

A stationary tower housing 162 includes a top opening 164 through which the upper section 152 of telescoping tower 140 protrudes. The lower portion of stationary tower housing 162 includes a ring gear 166 having a plurality of inwardly protruding ring gear teeth 168.

Figure 13:
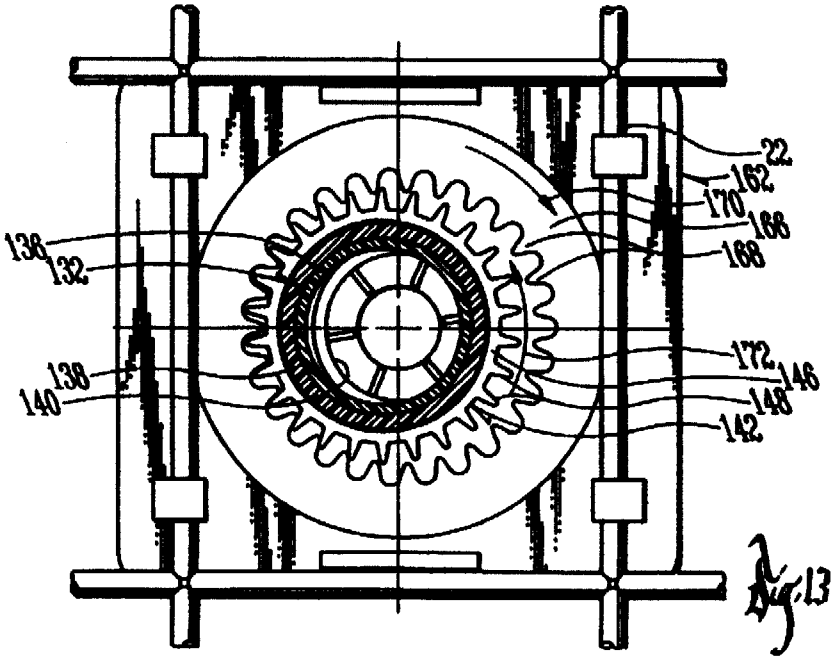
FIG. 13 is a sectional view taken along line 13—13 of FIG. 12.
Figure 11:
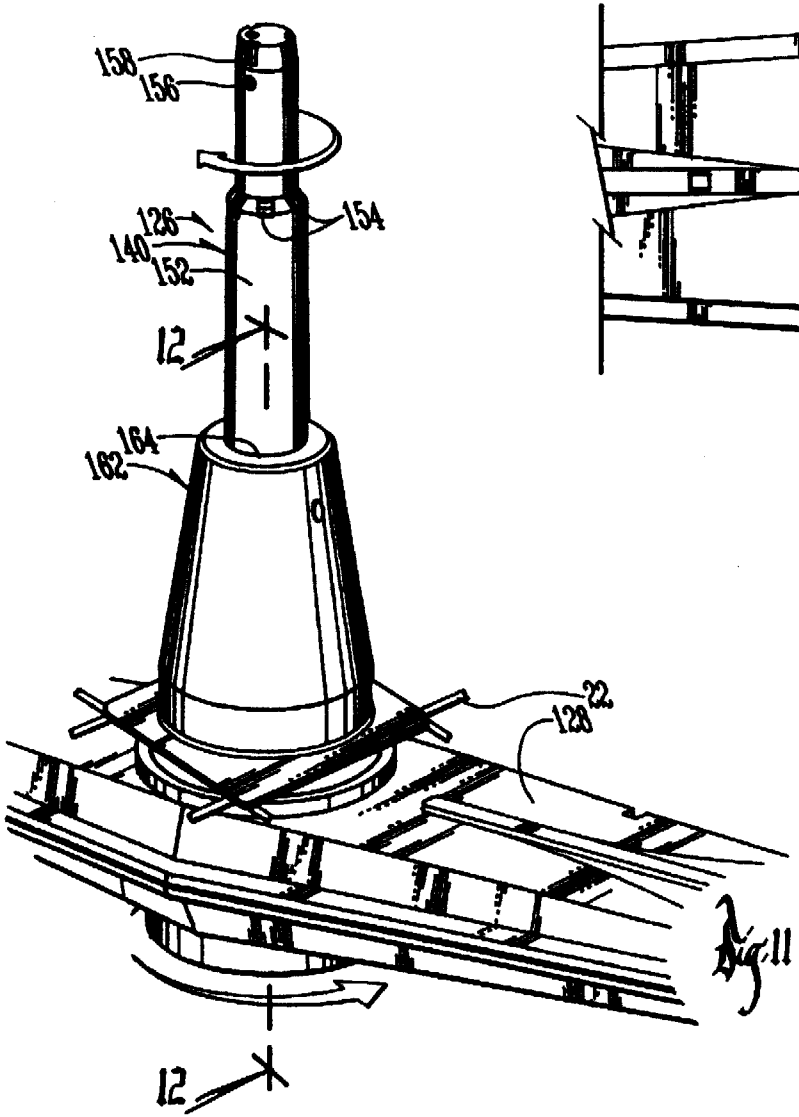
FIG. 11 is a perspective view of a modified form of the present invention.

In operation, the rotation of wash arm 128 causes the nozzle 136 to rotate in a concentric fashion about the rotational axis of wash arm 128. Referring to FIG. 13, the slightly misaligned lower end of bottom section 142 illustrates the eccentric off-center position of the vertical longitudinal axis of the telescoping tower 140. As the nozzle 136 moves in this circular pattern, it causes the planetary gear 146 to rotate around the ring gear teeth 168 of ring gear 166. This causes the telescoping tower 140 to tilt and precess due to the motion between the planetary gear 146 and the ring gear 166. That is, rotation of the nozzle 136 in a clockwise direction as designated by the arrow 170 in FIG. 13 causes the planetary gear 146 to rotate in a counter-clockwise direction at a much slower speed as indicated by the arrow 172. The rotation of planetary gear 148 in a direction opposite from the rotational direction of wash arm 128 also causes the telescoping tower 140 to rotate in the opposite direction from the wash arm 128 thereby creating a random spray pattern which is opposite to the rotating spray pattern caused by the wash arm 128. As the tilted assembly comprising the bottom section 142 and the tower section 140 precesses due to the gear reduction between the planetary gear 146 and the ring gear 166, the spray pattern generated by openings 154, 156 and 158 will rise and fall as the assembly rotates in a direction opposite to and at a much slower rate than the rotation of wash arm 128.

Figure 15:
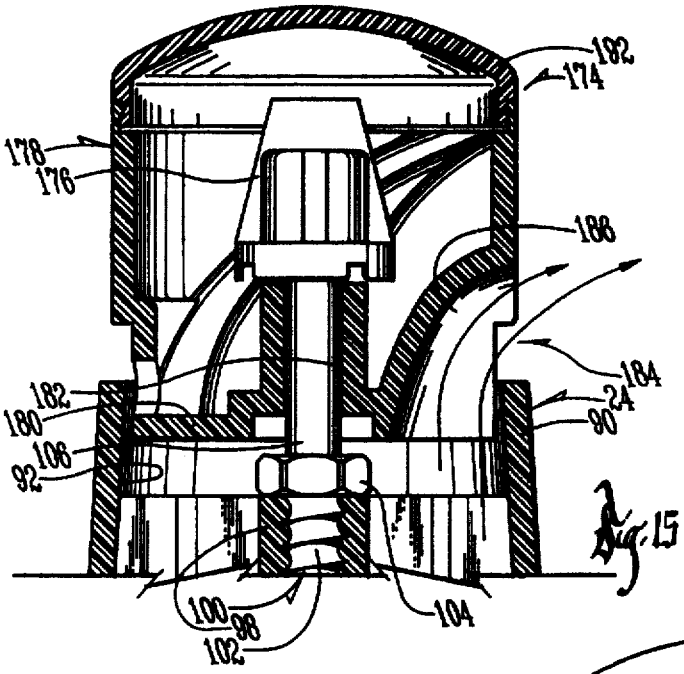
FIG. 15 is a vertical sectional view of another modified form of the present invention.
Figure 16:
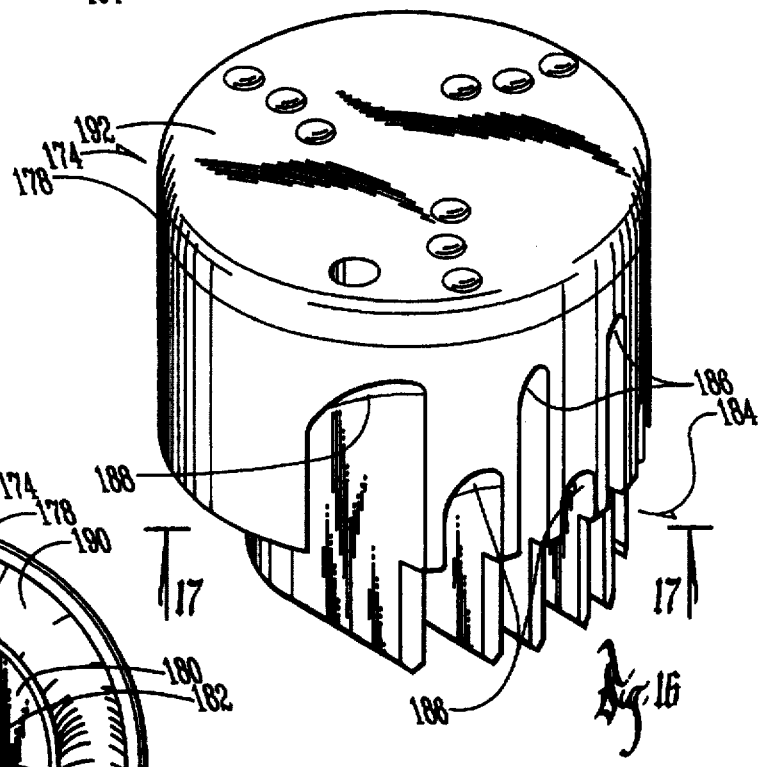
FIG. 16 is a perspective view of the modified diverter used in the device of FIG. 15.
Figure 17:
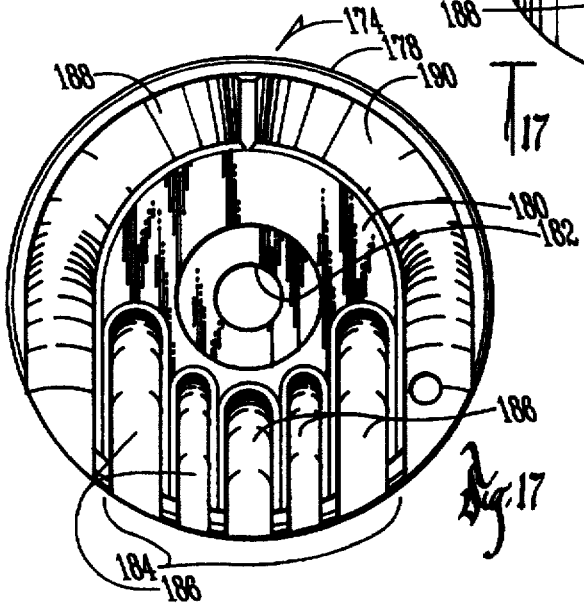
FIG. 17 is a bottom plan view taken along line 17—17 of FIG. 16.

Referring to FIG. 15, a modified form of diverter 108 is shown at 174. Diverter 174 is held in place by means of a nut or cap 176 on the top of shank 106. Diverter 174 includes a housing 178 having a bottom wall 180 with a central opening 182 therein which surrounds and slides vertically upon shank 106. Central opening 182 is slightly longer than the swivel opening 112 of diverter 108 so that it does not permit the diverter 174 to tilt on shank 106. However, the central opening 182 does permit the diverter 174 to slide vertically upward and downward and rotate on shank 106.

Diverter 174 includes a deflector surface 184 which is comprised of a plurality of deflector subsurfaces 186. Each of the deflector subsurfaces 186 is slightly different from the others so that each of them creates a slightly different spray pattern. A pair of helical deflector rotation surfaces 188, 190 are adapted to receive the column of water passing upward through the tower and because of their helical configuration they impart a rotational movement to the diverter 174. Thus as diverter 174 is struck by the rising column of water within the tower it moves upwardly to its upper most position on shaft 106 and begins rotating in unison with the circular pattern of the moving column of water within the spray tower 24. This diverter 174 does not precess as does the diverter 108, and it rotates in the same direction and in unison with the wash arm 20 below. A cap 192 is provided over the top of diverter 174.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A spray assembly comprising:

a fluid pump;

a spray tower having a lower stationary member and an upper rotatable member mounted for rotation about a first rotational axis with respect to said stationary member;

said stationary member having a fluid cavity therein, said rotatable member having a deflecting surface;

a spray nozzle connected to said fluid pump for receiving pressurized washing fluid therefrom and for directing a stream of said washing fluid into said fluid cavity and into contact with said deflecting surface of said rotatable member;

said spray nozzle being rotatable about a nozzle axis for moving said stream of washing fluid in a pattern which extends circumferentially around said first rotational axis of said rotatable member;

said deflecting surface being shaped to cause rotation of said rotatable member about said first rotational axis in response to being struck by said stream of washing fluid.

2. A spray assembly according to claim 1 wherein the position of said spray nozzle, the direction of said first rotational axis of said rotatable member, and the shape of said deflecting surface on said rotatable member are chosen so as to cause precession of said rotatable member.

3. A spray assembly according to claim 2 and further comprising a swivel connection between said rotatable member and said stationary member for permitting tilting of said rotatable member about said first rotational axis and movement of said rotatable member in a cone shaped locus.

4. A spray assembly according to claim 1 wherein said deflecting surface comprises a plurality of subsurfaces which are elongated and each of which have a longitudinal axis, said longitudinal axis of said subsurfaces extending in a radial direction with respect to said first rotational axis.

5. A spray assembly according to claim 4 wherein said subsurfaces each are U-shaped in cross-section.

6. A spray assembly according to claim 5 wherein at least some of said subsurfaces have a shape which differs in size and shape from the other of said subsurfaces.

7. A spray assembly according to claim 1 wherein said rotatable member further includes structure defining a port extending there through for directing a portion of said stream of washing fluid through said rotatable member.

8. A spray assembly according to claim 1 wherein said stationary member includes a plurality of elongated ribs extending within said fluid cavity for engaging and guiding said stream of washing fluid from said spray nozzle to said rotatable member.

9. A spray assembly according to claim 8 and further including an annular ring at the end of said elongated ribs for inwardly directing said stream of washing fluid.

10. A dish washing appliance comprising:

a washing tub having side walls, a bottom wall, and a top wall forming a washing compartment therein;

a wash arm rotatably mounted within said washing compartment for rotation about an upstanding axis, said wash arm having a manifold therein with an inlet opening and a plurality of spray openings therein;

a fluid pump for delivering pressurized fluid to said inlet opening of said manifold so as to cause said fluid to be sprayed outwardly from said spray openings;

a spray tower having a lower stationary member and an upper rotatable member mounted for rotation about a first rotational axis with respect to said stationary member;

said stationary member having a fluid cavity therein, said rotatable member having a spray opening therein in communication with said fluid cavity for receiving fluid therefrom and for directing said fluid outwardly away from said spray tower;

a spray nozzle connected to said fluid pump for receiving said pressurized washing fluid therefrom and for directing a stream of said washing fluid into said fluid cavity of said stationary member and outwardly through said spray opening of said rotatable member;

said spray nozzle being rotatable about a nozzle axis for moving said stream of washing fluid in a pattern which extends circumferentially around said first rotational axis of said rotatable member;

said rotatable member having a deflecting surface for receiving said stream of washing fluid and for causing rotation of said rotatable member about said first rotational axis.

11. A dish washing appliance according to claim 10 wherein said spray nozzle engages said wash arm and rotates with said wash arm.

12. A dish washing appliance according to claim 11 wherein said spray nozzle rotates at the same rotational velocity as said wash arm.

13. A dish washing appliance according to claim 12 wherein said spray nozzle causes said stream of washing fluid to move around said first rotational axis of said rotatable member at the same velocity as said rotational velocity of said wash arm, and said rotatable member rotates in response to being contacted by said stream of washing fluid at a rotational velocity which is different from said rotational velocity of said wash arm.

14. A dish washing appliance according to claim 13 wherein said rotatable member rotates at a slower rate than said wash arm for lengthening the dwell time of said stream of fluid deflected by said deflecting surface toward any particular area of said washing chamber.

15. A dish washing appliance according to claim 10 wherein said spray tower includes structure defining at least one aperture for directing a portion of said stream of washing fluid in a direction angularly disposed therefrom.

* * * * *